US005389057A

United States Patent [19]

Zagata, Jr.

[11] Patent Number: 5,389,057

[45] Date of Patent: Feb. 14, 1995

[54] EXERCISE APPARATUS FOR PRACTICING OFFENSIVE AND DEFENSIVE TECHNIQUES

[76] Inventor: Ronald Zagata, Jr., 1570 King Arthur Way, Streetsboro, Ohio 44241

[21] Appl. No.: 162,890

[22] Filed: Dec. 8, 1993

[51] Int. Cl.[6] ..... A63B 69/20

[52] U.S. Cl. ..... 482/83; 482/86; 482/87

[58] Field of Search ..... 482/83, 85–87, 482/89, 90, 92; 273/55 A, 368

[56] References Cited

U.S. PATENT DOCUMENTS

| | | | |
|---|---|---|---|
| 825,860 | 7/1906 | McKenzie | 482/86 X |
| 925,342 | 6/1909 | Johnson . | |
| 1,733,709 | 10/1929 | Zinnow et al. | 482/90 |
| 3,096,979 | 7/1963 | Lacy | 482/92 |
| 4,139,193 | 2/1979 | Felber et al. . | |
| 4,345,755 | 8/1982 | Eidson | 482/87 |
| 4,593,901 | 6/1986 | Moore et al. | 482/87 |
| 4,662,630 | 5/1987 | Dignard et al. . | |
| 4,749,184 | 6/1988 | Tobin . | |
| 4,817,941 | 4/1989 | McCorry . | |
| 4,913,419 | 4/1990 | McAuliffe | 482/87 |
| 4,923,164 | 5/1990 | Stenberg | 248/156 X |
| 5,046,724 | 9/1991 | Sotomayer . | |

FOREIGN PATENT DOCUMENTS

| | | | |
|---|---|---|---|
| 21280 | 5/1992 | Australia | 482/90 |
| 463046 | 7/1928 | Germany | 482/86 |
| 1533711 | 1/1990 | U.S.S.R. | 482/87 |

*Primary Examiner*—Richard J. Apley
*Assistant Examiner*—John Mulcahy
*Attorney, Agent, or Firm*—Richard C. Litman

[57] ABSTRACT

An exercise apparatus, which may be used for training in martial arts, boxing or the like, is disclosed. The apparatus is comprised of a target including an inflatable leather bag supported by the end of a padded, cantilevered arm. The arm is formed of a resilient material for absorbing energy from impact resulting from a punch or kick. The arm is attachable to a stand via an adjustment bracket which permits the height of the target to be varied in accordance with the user. Opposite the target is a counter weight. The counter weight has a threaded aperture therein for receiving an optional handle accessory. The handle allows a second participant to manually manipulate the leather bag to increase the difficulty of the exercise for the user.

14 Claims, 3 Drawing Sheets 10
23

40
62
54
46
42
50
72
A
A
48
46
24
71
20
28
22
25
26
27
29

EXERCISE APPARATUS FOR PRACTICING OFFENSIVE AND DEFENSIVE TECHNIQUES

BACKGROUND OF THE INVENTION

1. Field of the Invention

The present invention relates to athletic practice equipment and, more particularly, to a striking or kick-board apparatus for practicing punching and kicking without the assistance of an additional person nor repeated intervention by the participant to restore the apparatus.

2. Description of the Prior Art

Free-standing exercise devices for training in martial arts, boxing, and the like have been the subject of earlier patents. For example, U.S. Pat. No. 4,749,184, issued Jun. 7, 1988 to Edward D. Tobin, discloses a portable, free-standing kicking practice apparatus. The apparatus is a pivotable, spring biased member including a self-restoring, impact receiving member extending in a cantilevered fashion. The impact receiving member has a padded sleeve thereabout. The device incorporates a height adjustment mechanism to accommodate the kicking height of the user. U.S. Pat. No. 4,662,630, issued May 5, 1987 to Michael J. Dignard et al., discloses a martial arts striking apparatus including a striking board mountable at different heights and at different angles.

Another patents deemed of interest includes U.S. Pat. No. 925,342, issued Jun. 15, 1909 to Scott W. Johnson, who discloses a punching bag. Johnson identifies the use of a base plate with a plurality of openings adapted for receiving securing elements for retaining the apparatus against a floor or other suitable supporting structure. U.S. Pat. No. 4,139,193, issued Feb. 13, 1979 to David P. Felber et al., discloses a kick training aid for karate including a mounting base for bolting the aid to the ground.

Other patents deemed of interest include U.S. Pat. No. 5,046,724, issued Sep. 10, 1991 to Manuel F. Sotomayer, discloses a punching device for boxers; and U.S. Pat. No. 4,817,941, issued Apr. 4, 1989 to Tim McCorry, who discloses an adjustable target holder for martial arts training. The punching device disclosed by Sotomayer includes two outwardly extending, oppositely situated impact receiving members which allow one more two persons to simultaneously practice boxing techniques. McCorry provides a different dimension to kicking and boxing exercise devices.

None of the above inventions and patents, taken either singly or in combination, is seen to describe the instant invention as claimed.

SUMMARY OF THE INVENTION

The present invention is an exercise apparatus for training in martial arts, boxing or the like. The apparatus comprises a target including an inflatable leather bag supported by the end of a padded, cantilevered arm. The arm contains a spring for absorbing energy from impact resulting from a punch or a kick. The arm is attachable to a stand via a height adjustment bracket which permits the height of the target to be adjusted according to the user's preference. Opposite the target is a counter weight which has a threaded aperture therein for receiving an optional handle accessory. The handle allows a second participant to manually manipulate the leather bag so as to increase the difficulty of the exercise for the user.

Accordingly, it is a principal object of the invention to provide an exercise apparatus that assists a user in improving his or her different kicks, punches, blocks, and combinations of the same.

It is another object to provide an exercise apparatus to assist a user in the development of speed, timing, power, coordination, balance, focus, and accuracy.

It is a further object that the exercise apparatus has a lightweight target with sufficient mobility to reduce the risk of damage to the user's knee and ankle joints, and to the user's feet, which may otherwise occur through the use of a heavy bag.

Another object is that the elevation of the target be adjustable in accordance with a user's preference.

Yet another object is that a target support be provided which is structured add configured to dampen the impact that the target receives by the user.

Still another object is that the exercise apparatus be structured and configured to reduce the risk of inflicting injury upon the user thereof.

It is another object to ensure that the stability of the exercise apparatus is not compromised by the inertial effects created by the mobility of the target.

A further object is that the exercise apparatus be utilized independently or with a second participant who may manipulate the target to increase the difficulty of the user's exercise.

Still another object is that the exercise apparatus be suitable for use indoors and outdoors.

It is yet another object to provide an exercise apparatus that may be structured and configured to be easily assembled and disassembled.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
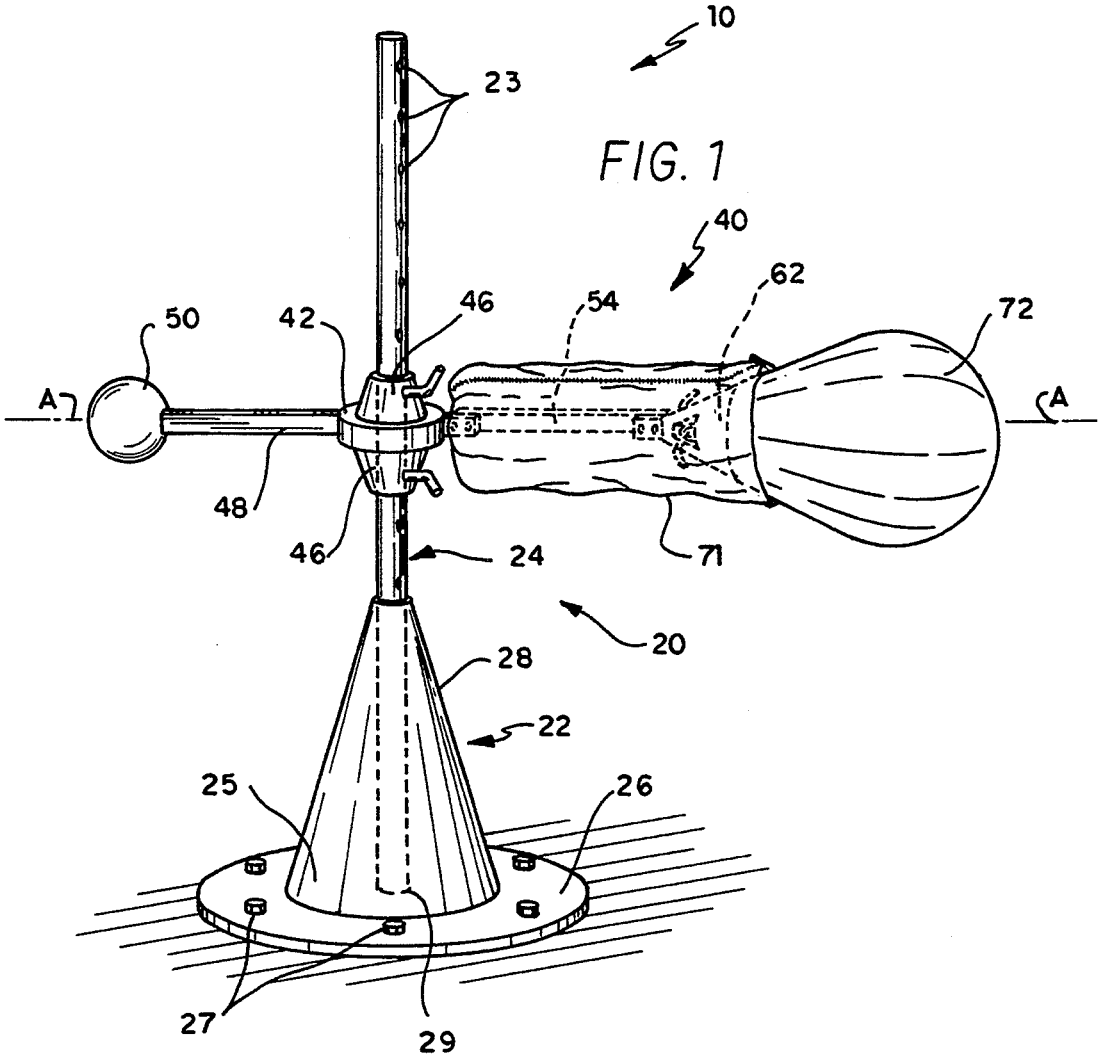
FIG. 1 is a perspective view of an exercise device according to the present invention.

The present invention, as is shown in FIG. 1, is exercise apparatus 10 for use in practicing martial arts techniques and, more particularly, for practicing kicking, punching, and blocking techniques. The apparatus 10 comprises a base assembly 20 for supporting a target assembly 40.

The base assembly 20 is comprised of a base member 22 and a standard 24. The base member 22 includes a bottom plate-like member 25 and a conical portion 28.

The conical portion 28 originates from the plate-like member 25. A peripheral flange 26 by formed by a portion of the plate-like member 25 extending beyond the perimeter of the conical portion 28. The conical portion 28 terminates at a junction with the standard 24. An upper end of the standard 24 extends upward substantially vertically from the tapered or reduced diameter end of the conical portion 28. A lower end of the standard 24 extends downward substantially vertical and is received by a hole 29 in the center of the plate 25.

Figure 2:
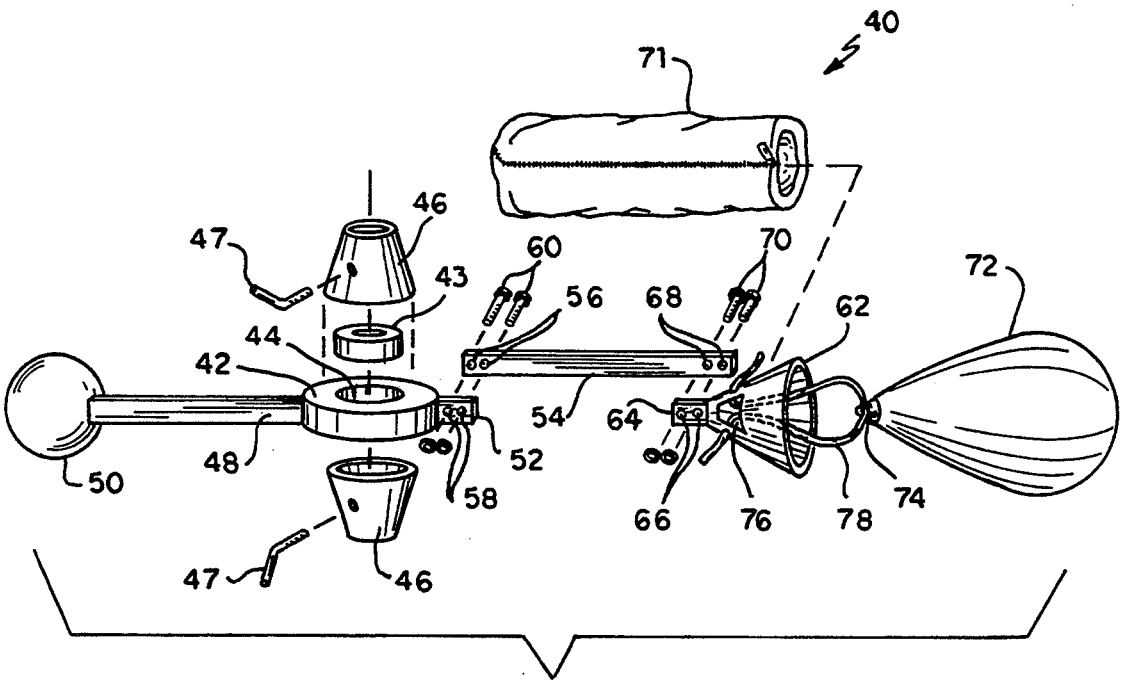
FIG. 2 is an exploded perspective view of the target assembly shown in FIG. 1.

The target assembly 40 includes a sleeve 42 having an opening 44 therein, as is shown more clearly in FIG. 2. The opening 44 is configured to receive the standard 24 therethrough. The sleeve 42 is slidably engageable with the standard 24. The height of the sleeve 42 may be varied according to the user's preference. The position of the sleeve 42 is fixed relative to the standard 24 through the cooperative engagement of a pair of locking collars 46.

A cantilevered arm 48 extends radially from the sleeve 42. The cantilevered arm 48 has a terminal end and a mass 50 supported by the terminal end. A first mounting bracket 52 extends radially from the sleeve 42 opposite the cantilevered arm 48. The first mounting bracket 52 is configured to support a cantilevered resilient arm 54. The first mounting bracket 52 and the resilient arm 54 include mutually aligning apertures 56, 58 for receiving threaded fasteners 60. The threaded fasteners 60 rigidly secure the resilient arm 54 to the first mounting bracket 52.

The resilient arm 54 has a terminal end configured to support a cup 62. The cup 62 includes a second mounting bracket 64. The terminal end of the resilient arm 54 and the second mounting bracket 64 have mutually aligning apertures 66, 68 for receiving threaded fasteners 70. The cantilevered arm 48, the resilient arm 54, and the cup 62 are all located along a common central axis A—A.

Figure 3:
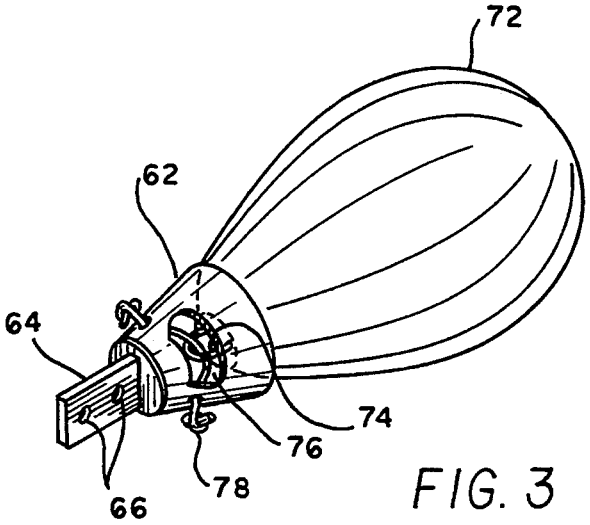
FIG. 3 is a side elevational view of the target and the attachment of the same to the cup.

The cup 62 defines a socket for receiving a target or bag 72. As is shown in FIG. 3, the target 72 is provided with a bail 74 and the cup 62 is provided with an access opening 76 which exposes the bail 74. A fastener 78 is used to tether the bail 74 of the target 72 to the cup 62.

Figure 4:
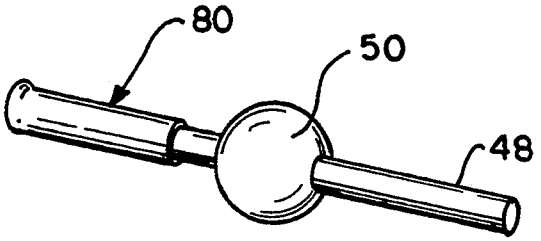
FIG. 4 is a perspective view of the handle and the attachment of the same to the counterweight.

Referring to FIG. 4, a handle 80 is shown engaging the mass 50. The handle 80 permits a second participant to manipulate the target assembly 40 to increase the difficulty of the user's exercise. The handle 80 may be maneuvered to displace the target 72 in an orbit about an axis defined by the standard 24 of the base assembly 20.

Figure 5:
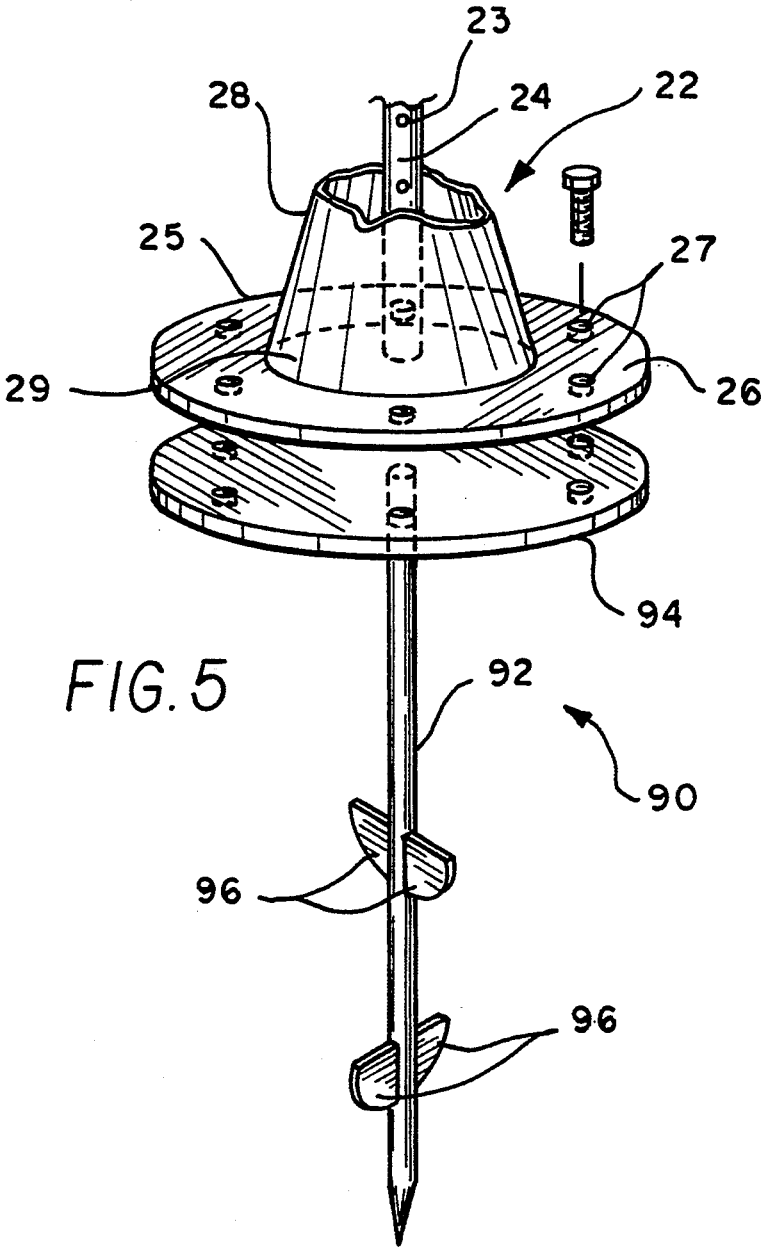
FIG. 5 is a perspective view of an anchor assembly for use with the exercise device.

The base assembly 20 is mountable against a rigid or firm supporting surface. A plurality of holes 27 are provided in the peripheral flange 26 of the base member 22 for receiving anchor fasteners (not shown) therethrough for securing the base member 22 to a supporting surface. As is shown in FIG. 5, an anchor member 90 permits the base assembly 20 to be mounted against a supple mounting surface. The anchor member 90 includes a shank 92 for supporting a platform 94 thereon. The platform 94 is supported substantially normal to the shank 92. The shank 92 includes a plurality of spaced apart radial fins 96. The fins 96 prevent the shank 92 from twisting during use. The dimensions of the platform 94 are proximate the dimensions of the peripheral flange 26 of the base member 22.

The base member 22 is dimensioned and configured to ensure that the stability of the exercise apparatus 10 is not compromised by the inertial effects created by the orbital motion of the target 72 moving about the axis of the standard 24. The wider the base member 22, the more stable the base assembly 20 becomes against centrifugal forces. The stability of the standard 24 relative to the base member 22 is accomplished through the cooperative engagement of the standard 24 with both the upper end of the conical portion 28 and the central hole 29 in the plate-like member 25. The greater the height of the conical portion 28, the more stable the standard 24 becomes. It is critical that the stability of the exercise apparatus 10 not be compromised by inertial forces. It has been found, for example, that a conical portion 24 having an enlarged diameter of 2 feet (60 cm) and a height of 2½ feet (75 cm), and a peripheral flange 26. The standard 24 extends to an elevation which permits a user to adjust the target 72 a suitable height for the user. A standard 24 which extends 5½ feet (157 cm) enables the target 72 to be elevated to a height sufficient for most user's.

Both the base member 22 and the standard 24 are fabricated of a rigid material, preferably a metal or a metal alloy. A solid steel bar having a 1 1/16 inch (2.5 cm) diameter should be adequate for forming the standard 24. The standard 24 is preferably attached rigidly to the base member 22, such as by welding, through a press fit configuration, or through matingly engageable threaded members or rivets, or a combination thereof. The standard 24 may be provided with a plurality of holes, dimples, or indentations 23 for engagement with the threaded member 47 of the locking collars 46. This reduces the risk of the collar 46 inadvertently moving over the course of use of the apparatus 10.

The target assembly 40 is fabricated of a rigid material and preferably a metal or a metal alloy. The opening 44 may be configured to receive a bearing 43. The bearing 43 may be press fit into the sleeve 42 and may slidably engage the standard 24 of the base assembly 20. The bearing 43 is intended to reduce friction between the base assembly 20 and the target assembly 40. This further increases the difficulty of the user's exercise.

The length and weight on the cantilevered arm 48 and the weight of the mass 50 are dependent of the length and weight of the cantilevered resilient arm 54 and characteristic properties of the target 72. The mass 50 may be a variable mass or may be displaced to calibrate the balance of the target assembly 40.

It should be noted that the target assembly 40 may be of unitary construction eliminating the need for mounting brackets, threaded fasteners, and the like.

The resilient arm 54 is preferably formed from a segment of light gauge spring metal or steel but may be formed from some other resilient material or body, such as a coil spring. The resilient arm 54 is purposed to dampen the impact that the target 72 receives by the user.

The target 72 and the cup 62 are not limited to the specific structure shown but each should be structured and configured to securely engage one another. The target 72 may be inflatable and may be covered with a durable covering, such as a leather or a vinyl covering. A padded sleeve or covering 71 is preferably provided for covering the resilient arm 54 and the cup 62. The padded covering 71 is intended to protect the user from striking the resilient arm 54 and the cup 62. Similar to that of the target 72, the padded covering 71 may be covered with a leather or a vinyl covering.

The cantilevered arm 48 is preferably blunt so reduce the risk of injury to the user. For example, a cantilevered arm formed of a rigid tubular body is deficient of a sharp edge and therefore reduces the risk of lacerating the user. Moreover, by providing a blunt mass 50, such as a spherical mass, the risk of injury to the user is further reduced.

In use, the exercise apparatus 10 asists a user in improving his or her different kicks, punches, blocks, and combinations of the same. The apparatus 10 helps the user develop speed, timing, power, coordination, balance, focus, and accuracy. The lightweight target 72 and the mobility of the target 72 reduces risk of damage to the user's knee and ankle joints, and to the user's feet, which may otherwise occur through the use of a heavy bag. The exercise apparatus 10 according to the present invention may be used independently or may be used with a second participant who may manipulate the target 72 to increase the difficulty of the user's exercise.

It is to be understood that the present invention is not limited to the sole embodiment described above, but encompasses any and all embodiments within the scope of the following claims.

I claim:

1. A striking exercise apparatus for use in practicing offensive and defensive techniques, comprising:

a target assembly, said target assembly including a target and means for dampening an impact with said target;

means for supporting said target, said support means defining an axis, said target being movable about said axis;

a counter weight rotatable about said axis, said counter weight being rigidly fixed to and diametrically opposed to said target; and a handle releasably attached to said counter weight for manually manipulating said target.

2. A apparatus according to claim 1, wherein said target includes an inflatable bag.

3. A apparatus according to claim 1, wherein said target includes a durable covering.

4. A apparatus according to claim 1, further including means for adjusting a height of said target.

5. A apparatus according to claim 4, wherein said height adjustment means includes a member slidably engaged with said support means, said member being selectively engageable with said support means at varying heights.

6. A apparatus according to claim 1, wherein said dampening means is cantilevered from said support means.

7. A apparatus according to claim 1, further including a padded sleeve covering said dampening means.

8. A apparatus according to claim 7, wherein said padded sleeve includes a durable covering.

9. A apparatus according to claim 1, wherein said reactive counterweight includes an elongated cantilevered member having a terminal end and a mass engaged with said terminal end.

10. A apparatus according to claim 9, wherein said cantilevered member includes a rigid tubular body.

11. A apparatus according to claim 9, wherein said mass is configured in the form of a spherical shape.

12. A apparatus according to claim 1, Further including means for reducing friction between said support means and said target.

13. A striking exercise apparatus for use in practicing offensive and defensive techniques, comprising:

a target assembly including a target and means for dampening an impact with said target;

a base assembly for supporting said target, said base assembly including a standard defining an axis, said target extending away from said base assembly and being movable about said axis; said base assembly further including a base member having a first side and a second side; wherein said first side is attached to one end of said standard, and an anchor shank is attached to said second side of said base member, said anchor shank further includes a plurality of anchor fins depending from said anchor shank;

means for adjusting a height of said target, said height adjustment means being slidably engaged with said base assembly, said height adjustment means further being selectively engageable with said base assembly at various heights;

an elongated cantilevered member extending from said base assembly and being rigidly fixed to and diametrically opposed to said target, said cantilevered member having a terminal end and a mass engaged with said terminal end; and a handle for manually manipulating said target, said handle being releasably attached to said mass.

14. A striking exercise apparatus for practicing offensive and defensive striking techniques, said exercise apparatus comprising:

a target assembly, said target assembly including a substantially pliable target, a resilient arm for dampening an impact with said target, and means for coupling said target with said resilient arm;

a base assembly for supporting said target assembly, said base assembly including a base member and a standard, said base member including a plate and a conical portion integral with said plate, said plate having a diameter greater than that of said conical portion to provide a transverse peripheral flange about said conical portion, said flange including means for attachment to a supporting surface, said plate further having a central aperture passing therethrough, said standard being received by said aperture and extending from within said conical portion, said standard further defining an axis, said target being accurately movable about said axis;

means for adjusting a height of said target, said height adjustment means including a sleeve and a pair of opposed collars, said sleeve being integral with said resilient arm, said sleeve having a bearing seated therein, said bearing being slidably engaged with said standard so as to cantilever said resilient arm from said standard, said collars being selectively engageable with said standard at varying heights retaining said sleeve therebetween;

a counter weight rotatable about said axis, and rigidly fixed to and diametrically opposed to said target, said counter weight including an elongated cantilevered member extending from said base assembly, said cantilevered member having a terminal end and a mass engaged with said terminal end; and a handle for manipulating said target, said handle being releasably attached to said counter weight.

* * * * *